US007813659B2

(12) United States Patent
Kawaguchi

(10) Patent No.: US 7,813,659 B2
(45) Date of Patent: Oct. 12, 2010

(54) IMAGE FORMING APPARATUS AND METHOD OF CONTROLLING THE SAME

(75) Inventor: Hiroshi Kawaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 12/330,911

(22) Filed: Dec. 9, 2008

(65) Prior Publication Data

US 2009/0154944 A1 Jun. 18, 2009

(30) Foreign Application Priority Data

Dec. 14, 2007 (JP) ..... 2007-324009
Nov. 20, 2008 (JP) ..... 2008-297099

(51) Int. Cl.
*G03G 15/01* (2006.01)
*G03G 15/00* (2006.01)

(52) U.S. Cl. ..... 399/39; 399/49

(58) Field of Classification Search ..... 399/15, 399/39, 41, 44, 45, 49
See application file for complete search history.

(56) References Cited

U.S. PATENT DOCUMENTS 6,853,815 B2 * 2/2005 Tezuka et al. ..... 399/39
6,898,381 B2 * 5/2005 Maebashi et al. ..... 399/15
7,224,916 B2 * 5/2007 Iwakawa ..... 399/49
2003/0049040 A1 3/2003 Tezuka et al.
2007/0134013 A1 * 6/2007 Soya et al. ..... 399/49

FOREIGN PATENT DOCUMENTS

JP 2003-107833 4/2003

* cited by examiner

*Primary Examiner*—Sandra L Brase
(74) *Attorney, Agent, or Firm*—Fitzpatrick, Cella, Harper & Scinto

(57) ABSTRACT

This invention provides an image forming apparatus capable of more reliably detecting patches formed on a recording medium while suppressing an increase in the consumption of printing media and toners. In an image forming apparatus which detects the density or color of each patch of a patch array fixed on a recording medium that is conveyed and corrects an image formation condition based on the detection result, the patches are formed as the patch array so that the conveyance-direction length of each patch gradually increases in an order of detection by the patch detection unit, and the conveyance-direction length of each patch gradually increases according to increasing of a detection position variation amount of a patch in the order of detection by the patch detection unit.

8 Claims, 13 Drawing Sheets

FIG. 9

| | ITEM | UNIT | EMBODIMENT | RELATED ART |
|---|---|---|---|---|
| 1 | IMAGE EXPANSION AND CONTRACTION ERROR ON RECORDING MEDIUM AT PATCH DETECTION POSITION | ±% | 0.8 | 0.8 |
| 2 | POSITION ERROR CAUSED BY SPEED VARIATION AT PATCH DETECTION POSITION | ±% | 1 | 1 |
| 3 | MAXIMUM SHIFT BETWEEN LEADING EDGE OF RECORDING MEDIUM AND LEADING EDGE OF IMAGE (INCLUDING DETECTION ERROR)b | ±mm | 0.9 | 0.9 |
| 4 | SIZE OF RECORDING MEDIUM TO BE USED FOR PATCH PATTERN FORMATION (A3) | mm | 420 | 420 |
| 5 | MARGIN L0 AT LEADING EDGE OF RECORDING MEDIUM | mm | 5 | 5 |
| 6 | MARGIN AT TRAILING EDGE OF RECORDING MEDIUM | mm | 5 | 5 |
| 7 | IMAGE FORMATION ENABLE LENGTH ON RECORDING MEDIUM | mm | 410 | 410 |
| 8 | LEADING EDGE-SIDE MARGIN $\beta$ WHICH MUST BE INCLUDED IN ONE PATCH | mm | $\beta$ | 8.28 |
| 9 | TRAILING EDGE-SIDE MARGIN $\alpha$ WHICH MUST BE INCLUDED IN ONE PATCH | mm | $\alpha$ | 8.28 |
| 10 | MAXIMUM VALUE OF RECORDING MEDIUM CONVEYANCE SPEED AT PATCH DETECTION POSITION | mm/s | 201 | 201 |
| 11 | DETECTION SPOT DIAMETER $\phi d$ (ON RECORDING MEDIUM) OF COLOR SENSOR | mm | 1.8 | 1.8 |
| 12 | NUMBER k OF TIMES OF DETECTION IN ONE PATCH | TIMES | 3 | 3 |
| 13 | TIME NECESSARY FOR DETECTION OF ONE CYCLE BY COLOR SENSOR | s | 0.01 | 0.01 |
| 14 | MAXIMUM DISTANCE g OF MOVEMENT OF RECORDING MEDIUM DURING DETECTION OF ONE PATCH | mm | 4.02 | 4.02 |
| 15 | CONVEYANCE-DIRECTION LENGTH OF ONE PATCH | mm | PLn | 22.38 |
| 16 | NUMBER OF FORMABLE PATCHES | PIECES | 18 | 18 |
| 17 | NUMBER n OF TONES OF PATCH | TONES | 18 | 18 |
| 18 | LENGTH NECESSARY FOR FORMING ALL PATCHES (DISTANCE FROM LEADING EDGE OF RECORDING MEDIUM) | mm | 202.5 | 407.8 |

FIG. 10

| n | Ln | β(Ln) | γ | α (Ln+γ) | PLn | TRAILING EDGE POSITION OF nTH PATCH |
|---|---|---|---|---|---|---|
| 0 | 5 | — | — | — | — | — |
| 1 | 6.92 | 1.02 | 4.02 | 1.10 | 7.94 | 12.94 |
| 2 | 15.01 | 1.17 | 4.02 | 1.24 | 8.23 | 21.17 |
| 3 | 23.40 | 1.32 | 4.02 | 1.39 | 8.35 | 29.71 |
| 4 | 32.09 | 1.48 | 4.02 | 1.55 | 8.85 | 38.56 |
| 5 | 41.10 | 1.64 | 4.02 | 1.71 | 9.17 | 47.73 |
| 6 | 50.44 | 1.81 | 4.02 | 1.88 | 9.51 | 57.24 |
| 7 | 60.12 | 1.98 | 4.02 | 2.05 | 9.86 | 67.09 |
| 8 | 70.16 | 2.16 | 4.02 | 2.24 | 10.22 | 77.31 |
| 9 | 80.56 | 2.35 | 4.02 | 2.42 | 10.59 | 87.90 |
| 10 | 91.35 | 2.54 | 4.02 | 2.62 | 10.98 | 98.88 |
| 11 | 102.53 | 2.75 | 4.02 | 2.82 | 11.38 | 110.27 |
| 12 | 114.12 | 2.95 | 4.02 | 3.03 | 11.80 | 122.27 |
| 13 | 126.14 | 3.17 | 4.02 | 3.24 | 12.23 | 134.30 |
| 14 | 138.60 | 3.39 | 4.02 | 3.47 | 12.68 | 146.98 |
| 15 | 151.51 | 3.63 | 4.02 | 3.70 | 13.15 | 160.13 |
| 16 | 164.90 | 3.87 | 4.02 | 3.94 | 13.63 | 173.76 |
| 17 | 178.78 | 4.12 | 4.02 | 4.19 | 14.13 | 187.89 |
| 18 | 193.16 | 4.38 | 4.02 | 4.45 | 14.65 | 202.53 |
| 19 | 208.08 | 4.65 | 4.02 | 4.72 | 15.18 | 217.72 |
| 20 | 223.54 | 4.92 | 4.02 | 5.00 | 15.74 | 233.46 |
| 21 | 239.57 | 5.21 | 4.02 | 5.28 | 16.32 | 249.77 |
| 22 | 256.19 | 5.51 | 4.02 | 5.58 | 16.92 | 266.69 |
| 23 | 273.41 | 5.82 | 4.02 | 5.89 | 17.54 | 284.22 |
| 24 | 291.27 | 6.14 | 4.02 | 6.22 | 18.18 | 302.40 |
| 25 | 309.78 | 6.48 | 4.02 | 6.55 | 18.84 | 321.25 |
| 26 | 328.97 | 6.32 | 4.02 | 6.89 | 19.54 | 340.78 |
| 27 | 348.86 | 7.18 | 4.02 | 7.25 | 20.25 | 361.03 |
| 28 | 369.48 | 7.55 | 4.02 | 7.62 | 20.99 | 382.03 |
| 29 | 390.86 | 7.94 | 4.02 | 8.01 | 21.76 | 403.79 |

IMAGE FORMING APPARATUS AND METHOD OF CONTROLLING THE SAME

BACKGROUND OF THE INVENTION

1. Field of the Invention

The present invention relates to an image forming apparatus for forming an image on a recording medium, and a method of controlling the same.

2. Description of the Related Art

An image forming apparatus such as a printer or a copying machine using an electrophotographic method or an inkjet method is recently required to output a high-quality image. Particularly important factors that determine the quality of an output image are the tone of density and its stability. However, the density or chromaticity of an output image of an image forming apparatus varies due to the variable factors of units in the apparatus concerning environmental changes or long-time use. Note that "chromaticity" in this specification is a general term for information quantitatively representing a color. Chromaticity may be expressed as "color information" or "color value", or simply as "color". As a parameter to quantitatively represent a color, a general calorimetric system such as L*a*b* or XYZ can be adopted. Especially in an image forming apparatus using electrophotographic method, only a very small environmental variation may change the density or chromaticity and disturb the color balance. Hence, an arrangement for always maintaining a predetermined density is necessary.

In a current image forming apparatus, a density detection toner image (to be referred to as a patch hereinafter) of each color toner is formed on an image carrier such as an intermediate transfer member or a photosensitive member. A density sensor detects the density of each unfixed toner patch. Density control is done based on the detection result. However, the density control using the density sensor is performed by forming patches on an intermediate transfer member or a photosensitive drum and detecting them. No control is done for changes in the color balance of an image transferred and fixed on a recording medium later. That is, the density control using the density sensor cannot cope with these changes.

Japanese Patent Application Laid-Open No. 2003-107833 proposes an image forming apparatus which includes a sensor (to be referred to as a color sensor hereinafter) to detect the density or chromaticity of a patch formed on a recording medium and provides an image having excellent color reproductivity by correcting the density or chromaticity of a toner image based on a measurement result. The color sensor uses, as light-emitting elements, three or more kinds of light sources having different emission spectra such as red (R), green (G), and blue (B). Alternatively, the color sensor uses a light source for emitting white (W) light as a light-emitting element and includes three or more kinds of filters such as red (R), green (G), and blue (B) filters which have different spectral transmittances and are formed on the light-emitting element. The color sensor having such an arrangement can obtain three or more different outputs such as R, G, and B outputs.

FIG. 13 is a view showing an example of a patch array 1300 formed on a recording medium to correct color balance. A color sensor is designed to detect the patch array 1300 before the recording medium is discharged out of the apparatus. Generally, the color sensor starts detection when the recording medium has reached the color sensor. After detecting the first patch, the color sensor sequentially detects the patches at a predetermined timing, thereby obtaining the detection data of each patch.

In the above-described related art, however, when detecting the patches at a predetermined timing, the color sensor may detect a patch having a tone different from an assumed tone because of operation variations of the constituent elements caused by changes over time or environmental changes. If this situation occurs, the color balance correction accuracy degrades. The operation variations include, for example, variations in the outer diameter of a recording medium conveyance roller, and variations in the recording medium conveyance speed caused by, for example, environmental variations. The operation variations also include shrinkage of the recording medium that has passed through a fixing device, and expansion and contraction of an image until image formation on the recording medium.

To avoid the influence of these operation variations, it is necessary to determine the length of each patch to be used for color balance correction. More specifically, a sufficiently long patch needs to be set to enable reliable patch detection even in the presence of variations. For example, to cause an image forming apparatus using a color sensor to output a high-quality image, the number of patches must be increased to improve the color balance correction accuracy.

However, when the number of patches to be used for color balance correction, the conveyance-direction length of the recording medium, or the conveyance speed of the recording medium increases, toner image portions including margins must be provided at the leading and trailing edge portions of each patch. This leads to a waste of printing media and toners.

A predetermined time is necessary for the color sensor to detect one patch. For this reason, the patch conveyance-direction length must have a predetermined value or more. More specifically, when the number of patches to be used for color balance correction is increased, not all patches are already formed on one recording medium. Additionally, as the throughput of the image forming apparatus improves, the conveyance-direction length of one patch must be longer. Hence, the number of patches per recording medium decreases, and printing media and toners are consumed in large quantities at the time of color balance correction.

The recording medium having the patches for color balance correction is unnecessary for the user. Hence, printing media and toners are preferably used in smaller quantities.

SUMMARY OF THE INVENTION

The present invention enables realization of more reliable detection of patches formed on a recording medium while suppressing an increase in the consumption of printing media and toners.

According to an aspect of the present invention, an image forming apparatus comprises patch formation unit configured to form, on a recording medium, a patch array including a plurality of patches formed by toner images; fixing unit configured to fix, to the recording medium, the patch array formed on the recording medium; patch detection unit configured to detect a density or color of each patch of the patch array fixed on the recording medium that is conveyed; and correction unit configured to correct an image formation condition based on the detected density or color of the each patch, wherein the patch formation unit forms the patches as the patch array so that the conveyance-direction length of each patch gradually increases in an order of detection by the patch detection unit, and wherein the conveyance-direction length of each patch gradually increases according to increasing, from an ideal position, of a detection position variation amount of a patch in the order of detection by the patch detection unit.

According to another aspect of the present invention, a method of controlling an image forming apparatus, comprises the steps of forming, on a recording medium, a patch array including a plurality of patches by toner images; fixing, to the recording medium, the patch array formed on the recording medium; causing patch detection unit to detect a density or color of each patch of the patch array fixed on the recording medium that is conveyed; and correcting an image formation condition based on the detected density or color of the each patch, wherein in the patch forming step, the patches are formed as the patch array so that the conveyance-direction length of each patch gradually increases in an order of detection by the patch detection unit, and wherein the conveyance-direction length of each patch gradually increases according to increasing of a detection position variation amount of a patch in the order of detection by the patch detection unit.

Further features of the present invention will become apparent from the following description of exemplary embodiments with reference to the attached drawings.

BRIEF DESCRIPTION OF THE DRAWINGS

FIG. 9 is a view showing parameters associated with patch pattern formation of the embodiment and those of the related art;

FIG. 10 is a view showing the parameters of the patch pattern according to the embodiment;

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

<Overall Arrangement>

Figure 1:
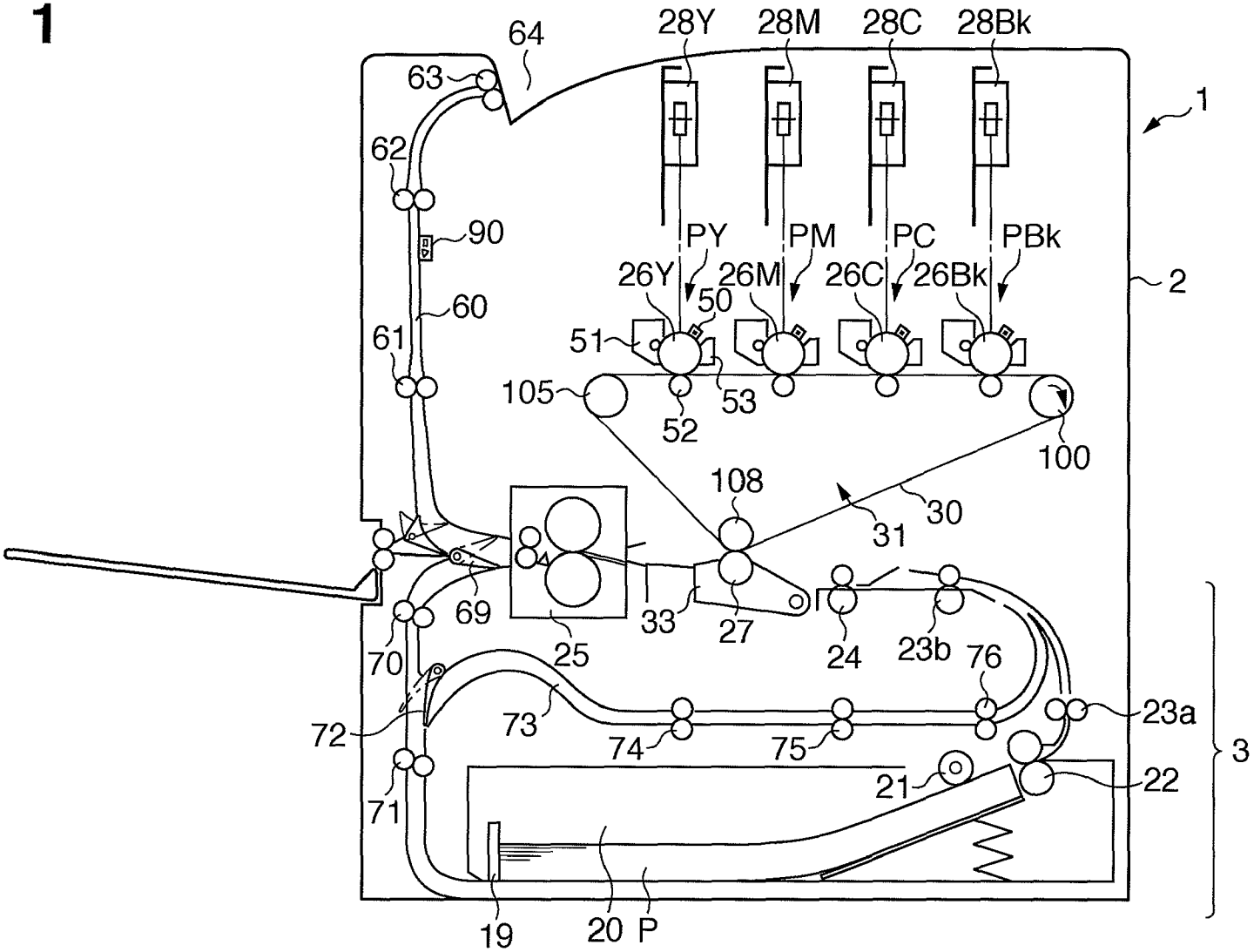
FIG. 1 is a sectional view showing the arrangement of a printer 1 according to the embodiment.

The arrangement of a printer 1 according to this embodiment will be described with reference to FIG. 1. FIG. 1 is a sectional view showing the arrangement of the printer 1 according to this embodiment. The printer 1 will be explained here as, out of image forming apparatuses using an electrophotographic method, a 4-drum full-color image forming apparatus using an intermediate transfer belt.

Referring to FIG. 1, reference numeral 2 denotes an apparatus main body that is the main body of the printer 1. Process cartridges P (PY, PM, PC, and PBk) of four colors, that is, yellow (Y), magenta (M), cyan (C), and black (Bk) are detachably provided in the apparatus main body 2. An intermediate transfer belt unit 31 has an intermediate transfer belt 30 serving as an intermediate transfer member. A fixing device 25 serves as a fixing unit.

The process cartridges P including photosensitive drums 26Y, 26M, 26C, and 26Bk, primary chargers 50, laser exposure devices 28Y, 28M, 28C, and 28Bk, and developers 51, respectively, are juxtaposed along the intermediate transfer belt 30. Each of the photosensitive drums 26Y, 26M, 26C, and 26Bk serves as an image carrier. Each primary charger 50 is arranged on the outer circumferential surface of a corresponding one of photosensitive drums 26 to uniformly charge the surface of the photosensitive drum 26. Each laser exposure device 28 exposes the surface of a corresponding one of the photosensitive drums 26 to form an electrostatic latent image. Each developer 51 develops an electrostatic latent image using a toner of a corresponding one of the colors: yellow, magenta, cyan, and black.

Primary transfer rollers 52 which oppose the photosensitive drums 26 while sandwiching the intermediate transfer belt 30 form a primary transfer unit together with the photosensitive drums 26. The intermediate transfer belt unit 31 includes the intermediate transfer belt 30, and three rollers, that is, a driving roller 100, tension roller 105, and secondary transfer counter roller 108, which tense the intermediate transfer belt 30.

A secondary transfer roller 27 is arranged on the opposite side of the secondary transfer counter roller 108 with respect to the intermediate transfer belt 30. A transfer conveyance unit 33 holds the secondary transfer roller 27. A feeding unit 3 feeds a recording medium P to a secondary transfer unit formed from the butt portion of the secondary transfer roller 27 and the secondary transfer counter roller 108 which sandwich the intermediate transfer belt 30 therebetween. The feeding unit 3 includes a cassette 20 which stores a plurality of printing media P, a feed roller 21, a pair of retarding rollers 22 for preventing multi feed, pairs of conveyance rollers 23*a* and 23*b*, and a pair of registration rollers 24.

Note that the cassette 20 has a trailing edge regulating plate 19 to regulate the trailing edges of the stacked printing media P. The trailing edge regulating plate 19 moves in accordance with the size of the printing media P stored in the cassette 20. A trailing edge regulating plate position detection unit (not shown) detects the conveyance-direction length of the printing media P. The detection of the conveyance-direction length of the recording medium P will be referred to as "size detection" hereinafter.

Pairs of discharge rollers 61, 62, and 63 are provided in the conveyance path downstream of the fixing device 25. A color sensor 90 made of a photosensor is installed in a discharge conveyance path 60 between the pairs of discharge rollers 61 and 62.

The printer 1 supports double-sided printing. After a recording medium which has undergone image formation on the first surface is discharged from the fixing device 25, a diverter 69 is switched to convey the recording medium P to the side of pairs of inverting rollers 70 and 71. When the trailing edge of the recording medium P has passed through a diverter 72, the printer 1 switches the diverter 72 and simultaneously rotates the inverting rollers 71 in the reverse directions to guide the recording medium P to a double-side conveyance path 73. Pairs of double-side conveyance path rollers 74, 75, and 76 are rotated to re-feed the recording medium P to enable printing on the second surface.

Figure 2:
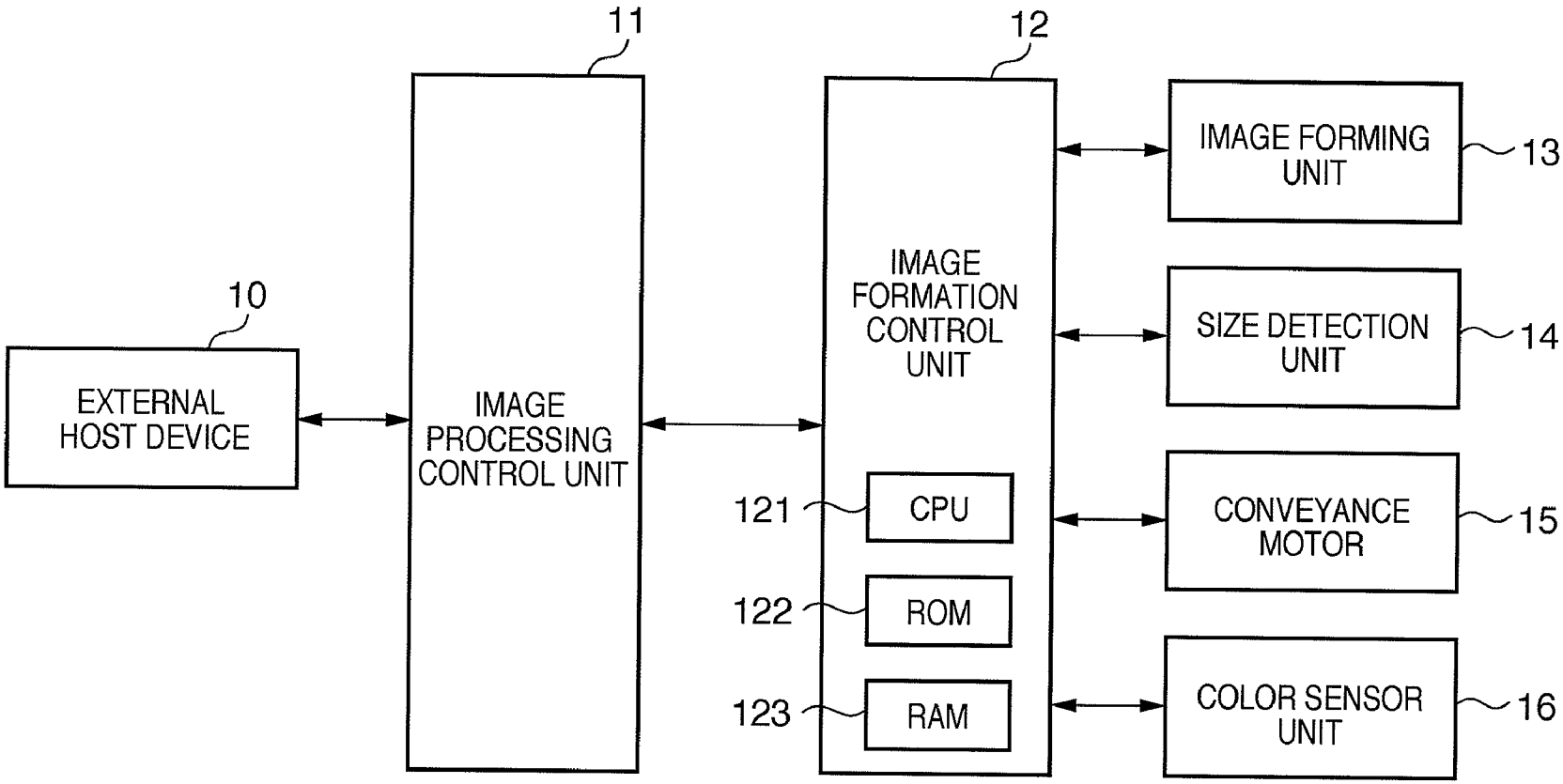
FIG. 2 is a block diagram showing the control blocks of the printer 1 according to the embodiment.

The control arrangement of the printer 1 will be described next with reference to FIG. 2. FIG. 2 is a block diagram showing the control blocks of the printer 1 according to this embodiment. Control blocks related to the present invention will mainly be explained here. That is, the printer 1 according to the present invention may include any other control blocks.

The printer 1 includes an image processing control unit 11, image formation control unit 12, image forming unit 13, size detection unit 14, conveyance motor 15, and color sensor unit 16. An external host device 10 such as a personal computer is connected to the printer 1 via a network. The printer 1 receives an image signal (RGB signals) from the external host device 10 or a document reading unit (not shown) separately provided on the apparatus main body.

The image processing control unit 11 converts the received RGB signals into CMYK signals, performs tone and density correction, and generates an exposure signal for the laser exposure devices 28. The image formation control unit 12 integrally controls image forming operations (to be described later) and also controls the apparatus main body at the time of color balance correction using the color sensor 90. The image formation control unit 12 includes a CPU 121 which controls the processing of the image formation control unit 12, a ROM 122 which stores programs to be executed by the CPU 121, and a RAM 123 which stores various kinds of data to be used for each processing of the CPU 121 and processing results.

The CPU 121 functions as a patch formation unit, patch detection unit, correction unit, determination unit, and change unit. When functioning as a patch formation unit, the CPU 121 forms a patch array including a plurality of patches formed by toner images on a recording medium by controlling the image forming unit 13. When functioning as a patch detection unit, the CPU 121 causes the color sensor unit 16 to control the color sensor 90 to detect the density or chromaticity of each patch of the patch array fixed on the recording medium by the fixing device 25. Note that "chromaticity" in this specification is a general term for information quantitatively representing a color. Chromaticity may be expressed as "color information" or "color value", or simply as "color". As a parameter to quantitatively represent a color, a general calorimetric system such as L*a*b* or XYZ can be adopted.

When functioning as a correction unit, the CPU 121 corrects, based on the detected density or chromaticity of the patch array, image formation conditions to be used to form an image on a recording medium of the same type as the recording medium with the formed patch array. When functioning as a determination unit, the CPU 121 determines the conveyance-direction length which is the length of a patch corresponding to the recording medium conveyance direction and is necessary for solving expansion and contraction of a toner image at the patch detection position of the color sensor 90 or a variation in the moving speed of the recording medium at the patch detection position. The CPU 121 determines the conveyance-direction length of a patch in accordance with the formation position of each patch on the recording medium. When functioning as a change unit, the CPU 121 changes the conveyance-direction length of a patch in accordance with the environment such as the temperature and humidity in which the image forming apparatus is placed, the intra-machine environment, or the number of times of image formation or the type of a recording medium.

The image forming unit 13 shown in FIG. 2 is a block which includes the engines shown in FIG. 1 and collectively represents the elements necessary for forming an image on the recording medium P. The size detection unit 14 detects the size of a recording medium the user uses for image formation. More specifically, the size detection unit 14 detects the size of a recording medium using the above-described trailing edge regulating plate 19. For correction using the color sensor, the image formation control unit 12 determines the number of printing media necessary for forming a correction patch pattern based on the detection result of the size detection unit 14. The conveyance motor 15 conveys the recording medium P through the apparatus main body 2 at a predetermined timing in accordance with an instruction from the image formation control unit 12. In this embodiment, the recording medium P is conveyed by a plurality of driving unit (not shown). The color sensor unit 16 detects patches on the recording medium P using the color sensor 90.

<Image Forming Operation>

The image forming operation of the printer 1 having the above-described arrangement will be described.

When the image forming operation starts, the printing media P in the cassette 20 are fed by the feed roller 21, separated by the pair of retarding rollers 22 to each sheet, and conveyed to the pair of registration rollers 24 via the pairs of conveyance rollers 23*a* and 23*b*. The pair of registration rollers 24 is at rest. The recording medium P abuts against the nip between the pair of registration rollers 24 so that skew of the recording medium P is corrected. Parallel to the conveyance operation of the recording medium P, in, for example, the process cartridge PY of yellow, the primary charger 50 uniformly negatively charges the surface of the photosensitive drum 26Y. Next, the laser exposure device 28Y performs image exposure to form an electrostatic latent image corresponding to the yellow image component of the document on the surface of the photosensitive drum 26Y.

The developer 51 develops the formed electrostatic latent image using a negatively charged yellow toner to visualize the latent image into a yellow toner image. The yellow toner image is primarily transferred onto the intermediate transfer belt 30 by the primary transfer roller 52. After toner image transfer, the residual toner on the surface of the photosensitive drum 26Y is removed by a cleaner 53 and used in the next image formation.

In the remaining process cartridges PM, PC, and PBk as well, the above-described image forming operation is sequentially performed at a predetermined timing. Color toner images formed on the photosensitive drums 26 are sequentially primarily transferred onto the intermediate transfer belt 30 in a superimposed manner by the respective primary transfer units.

The four color toner images transferred and superimposed on the intermediate transfer belt 30 are moved to the secondary transfer unit as the intermediate transfer belt 30 rotates in the direction of an arrow. The recording medium P whose skew is corrected by the pair of registration rollers 24 is conveyed in time with arrival of the images on the intermediate transfer belt 30 at the secondary transfer unit.

In the secondary transfer unit, the secondary transfer roller 27 abutting against the intermediate transfer belt 30 while sandwiching the recording medium P secondarily transfers the four color toner images from the intermediate transfer belt 30 to the recording medium P. The recording medium P having the transferred toner images is conveyed to the fixing device 25 and heated and pressed so that the toner images are fixed. After that, the recording medium P is discharged by the pairs of discharge rollers 61, 62, and 63 and stacked on the upper surface of the apparatus main body 2. After secondary transfer, a belt cleaner (not shown) removes residual toners from the surface of the intermediate transfer belt 30.

Figure 3:
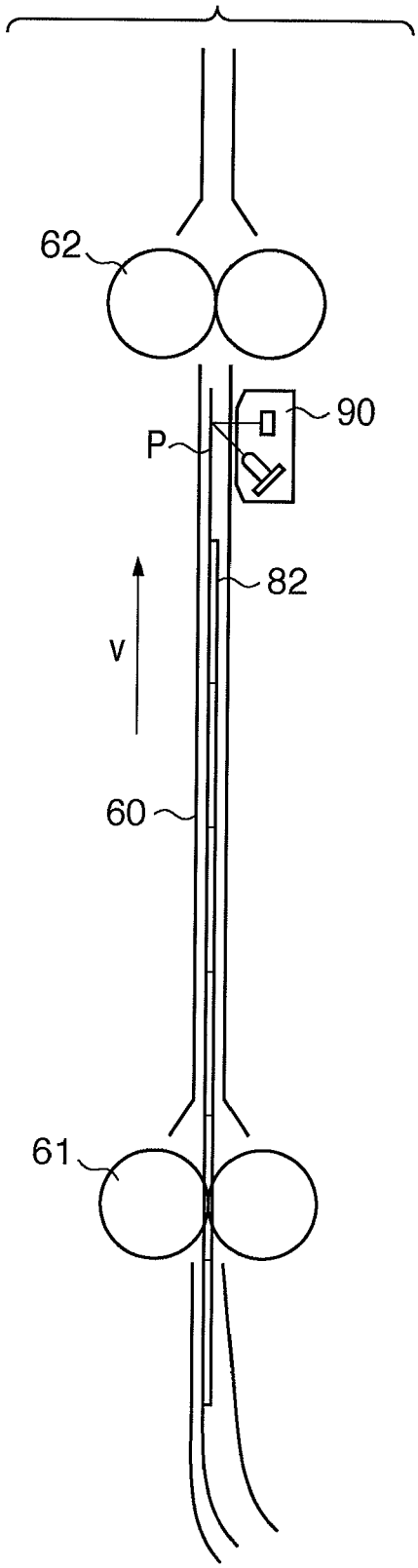
FIG. 3 is an enlarged view showing a discharge conveyance path 60 near a color sensor 90 according to the embodiment.

According to this embodiment, the color sensor 90 is installed in the discharge conveyance path 60 between the pairs of discharge rollers 61 and 62 downstream of the fixing device 25. FIG. 3 is an enlarged view showing the discharge conveyance path 60 near the color sensor 90 according to this embodiment.

As shown in FIG. 3, the color sensor 90 is directed to the image formation surface of the recording medium P to detect a toner image fixed on the recording medium P by the fixing device 25. The color sensor 90 irradiates the recording medium P that is being conveyed with light. The color sensor 90 receives the light reflected by the recording medium P or a toner image formed on the recording medium P and outputs RGB signals. That is, the color sensor 90 detects the RGB values of a patch pattern 82 formed and fixed on the recording medium P. The color sensor 90 is designed to perform detection during conveyance of the recording medium P before it is discharged out of the apparatus main body 2.

<Arrangement of Color Sensor>

Figure 4:
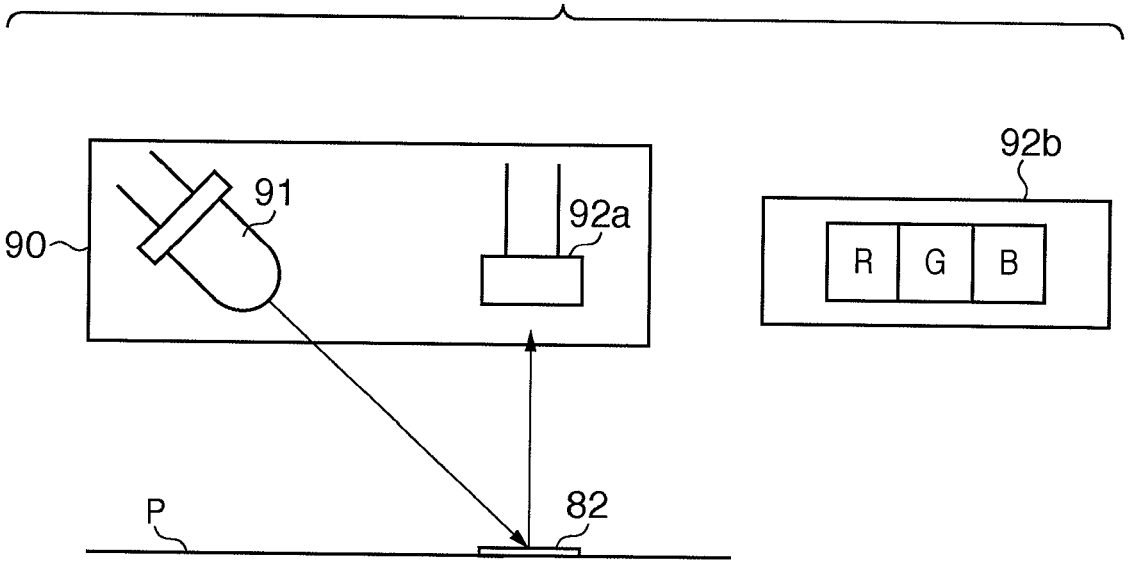
FIG. 4 is a view showing an example of the arrangement of the color sensor 90 according to the embodiment.

The arrangement of the color sensor 90 will be described next with reference to FIG. 4. FIG. 4 is a view showing an example of the arrangement of the color sensor 90 according to this embodiment.

The color sensor 90 includes a write LED 91 and a charge-storage sensor 92*a* with an RGB on-chip filter. The write LED 91 is arranged to make light enter from the direction of 45° to the recording medium P having fixed patches. The charge-storage sensor 92*a* is arranged to detect diffused reflected light in the direction of 0°. A light-receiving portion 92*b* of the charge-storage sensor 92*a* serves as a filter having independent R, G, and B pixels. The charge-storage sensor 92*a* may be, for example, a photodiode. The charge-storage sensor 92*a* may have several sets of R, G, and B pixels. The angle of incidence may be 0°, and the angle of reflection may be 45°. The color sensor 90 may include LEDs which emit three R, G, and B light components, and a sensor without a filter.

<Color Balance Correction>

Figure 5:
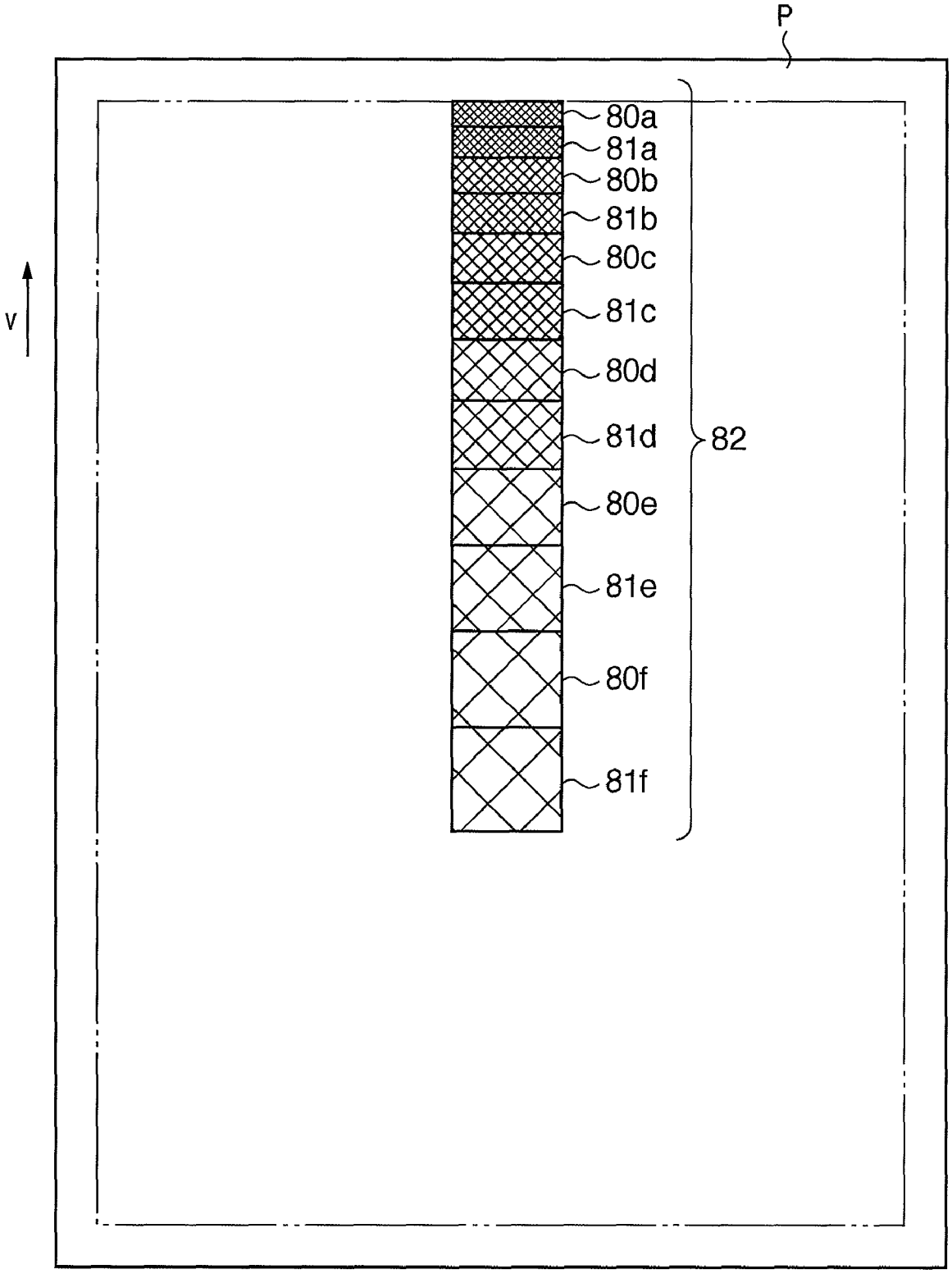
FIG. 5 is a view showing a patch pattern 82 according to the embodiment.

Color balance correction will be described next with reference to FIG. 5. FIG. 5 is a view showing the patch pattern 82 according to this embodiment. The patch pattern is a patch array including a plurality of patches (toner images) formed almost in a line. The plurality of patches are generally toner images having different densities (tones). In color balance correction according to this embodiment, after the patch pattern 82 is fixed on the recording medium P, RGB values are detected using the color sensor 90, and the tone-density characteristic is controlled.

The patch pattern 82 is a tone patch pattern of gray which is a very important color for color balance and is located at the center of the color reproduction range. More specifically, the patch pattern 82 includes gray tone patches 80 formed using black (Bk), and process gray tone patches 81 formed by mixing cyan (C), magenta (M), and yellow (Y). A Bk gray tone patch 80 and a CMY process gray tone patch 81, which have almost the same chromaticity in a standard image forming apparatus, are paired and formed as patches 80*a* and 81*a*, 80*b* and 81*b*, 80*c* and 81*c* . . . .

In the color balance correction, the RGB values of the plurality of patches are detected using the color sensor 90. The detection result is fed back to the image processing control unit 11. The image processing control unit 11 compares the RGB values of the Bk gray tone patch 80 with those of the CMY process gray tone patch 81, thereby generating color balance correction data. More specifically, the image processing control unit 11 calculates the mixing ratio of the three CMY colors of a process gray patch which is formed by mixing the three CMY colors and has almost the same chromaticity as a gray patch of a given tone, thereby generating color balance correction data. The color balance correction data is used to control the density or chromaticity of a toner image. This enables to form a toner image of optimum color balance.

The color balance correction is executed in the intervals of normal printing operations. The color balance correction is executed at a preset timing after detecting environmental variations or the number of printed sheets. Alternatively, a user who desires execution manually executes the color balance correction.

The difference between the arrangement of the patch pattern 82 and a detection method employed in this embodiment and those of the related art will be described next.

Figure 13:
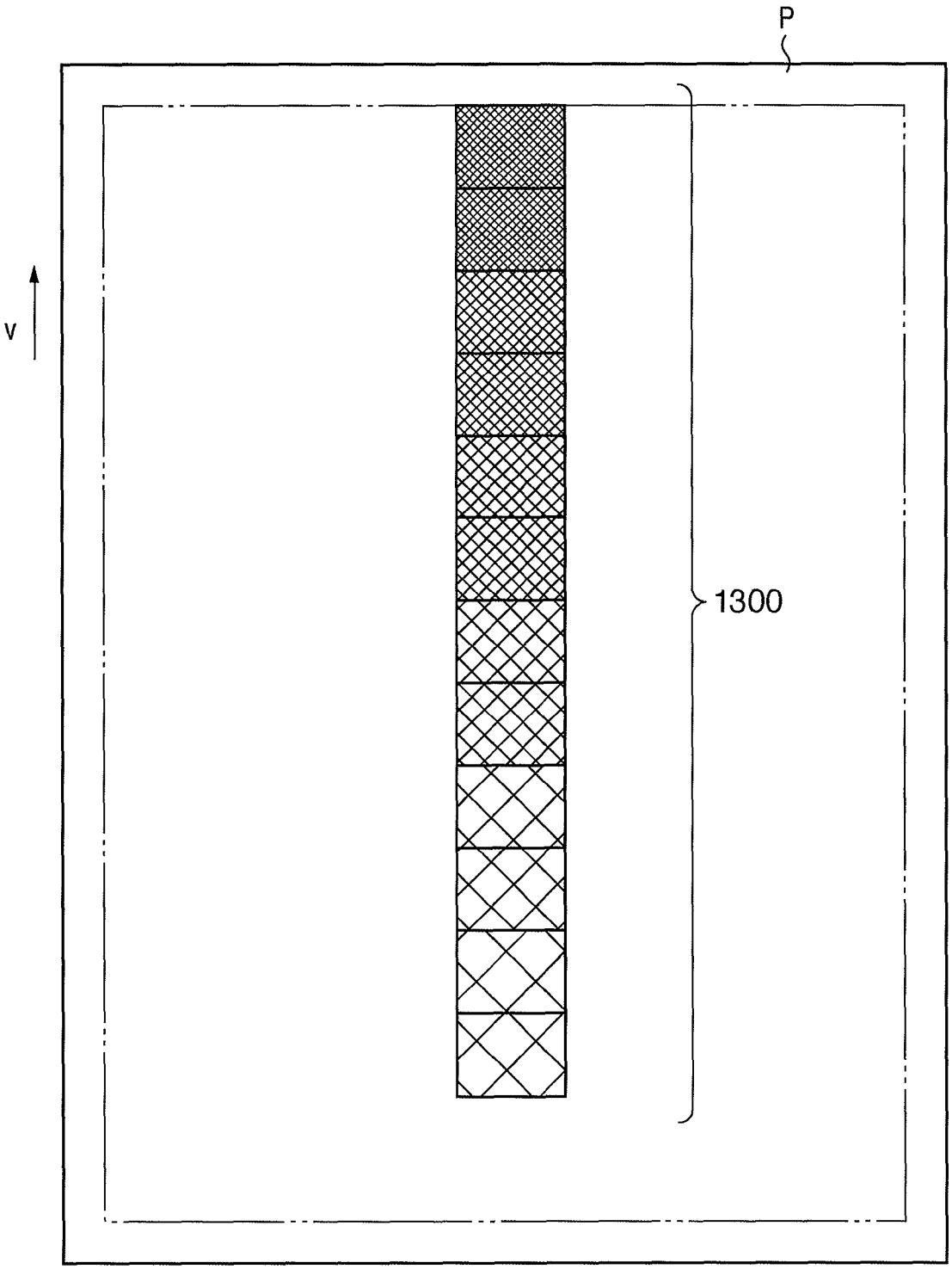
FIG. 13 is a view showing an example of a patch array 1300 formed on a recording medium to correct color balance.

The patch pattern 82 shown in FIG. 5 is formed such that the conveyance-direction length of each patch gradually increases from the first patch (the patch to be detected first) to the last patch in the conveyance direction, unlike the conventional patch pattern shown in FIG. 13. The sum of the conveyance-direction lengths of all patches is smaller than that of the related art.

As for patch detection in the conventional printer, detection starts (the write LED starts light emission) immediately before a recording medium reaches the color sensor. Arrival of the leading edge of the recording medium is determined based on variations in the detection value. Then, the patches are sequentially detected at a predetermined timing, thereby obtaining detection data. In patch detection of this embodiment, after arrival of the leading edge of a recording medium is detected, as in the related art, the patches which gradually increase the conveyance-direction length along the conveyance direction are sequentially detected at appropriate timings.

Figure 6:
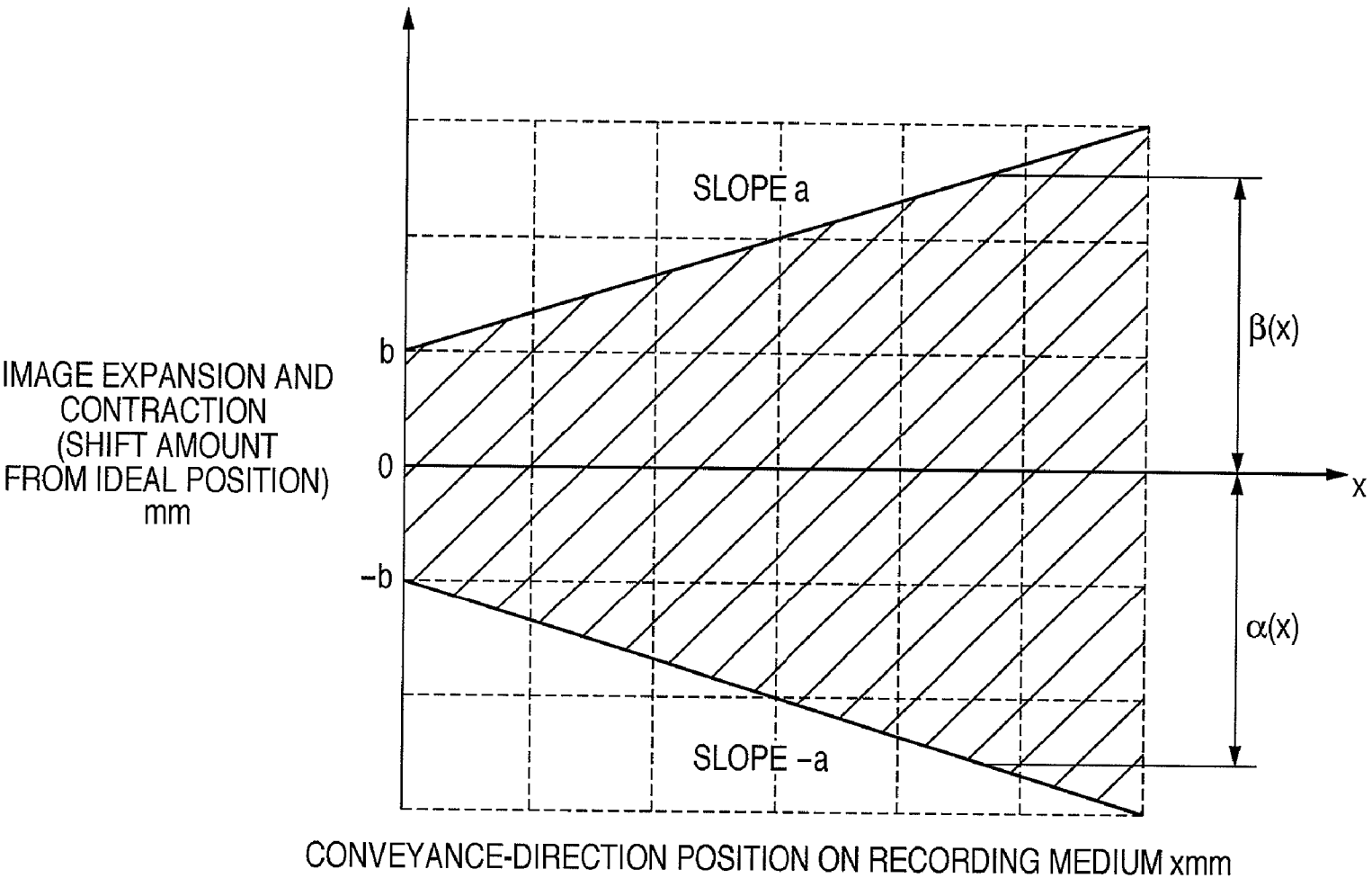
FIG. 6 is a graph showing an example of the expansion and contraction characteristic of an image formed on a recording medium by the printer 1.

The reason why the patch pattern 82 can be shorter than before will be explained. FIG. 6 is a graph showing an example of the expansion and contraction characteristic of an image formed on a recording medium by the printer 1. In FIG. 6, the conveyance-direction position on the recording medium is plotted along the abscissa as the distance (mm) from the leading edge of the recording medium, and the expansion and contraction of the image is plotted along the ordinate as the shift (mm) from the ideal position. Expansion and contraction indicates the shift from the ideal position, as shown along the ordinate of FIG. 6. It does not indicate only physical expansion and contraction of the patch conveyance-direction length itself.

The hatched region in FIG. 6 indicates the range where the image on the recording medium shifts from the ideal position. This shift occurs due to various kinds of variations such as variations in the outer diameter of the recording medium conveyance roller, variations in the recording medium conveyance speed caused by, for example, environmental variations, shrinkage of the recording medium that has passed through the fixing device 25, and expansion and contraction of an image until image formation on the recording medium.

Referring to FIG. 6, $\beta(x)$ is the image expansion amount from the ideal position, that is, a position x, and $\alpha(x)$ is the image contraction amount from the ideal position, that is, the position x. The image expansion and contraction amount is an expansion and contraction amount when the length of the image itself (patch itself) physically expands or contracts, or the amount of shift of the image from the ideal position caused by, for example, variations in the recording medium moving speed without any physical expansion and contraction of the length of the image itself. In this embodiment, $$\alpha(x)=\beta(x)=ax+b$$

based on the result of actual measurement using the apparatus main body 2.

In the conventional patch pattern, all patches are set to have the same conveyance-direction length. Hence, a patch pattern is formed by causing each patch to include an image shift which must be included in the last patch. Hence, as a patch nears the leading edge of the recording medium, it becomes long more than necessary. In this embodiment, however, a patch having an optimum conveyance-direction length is formed at each position. This reduces wasteful toner consumption.

In this embodiment, when determining the conveyance-direction length of each patch, a detection margin (margin) is set for each patch in consideration of the image expansion and contraction characteristic as shown in FIG. 6 to reliably detect the patch.

Figure 7:
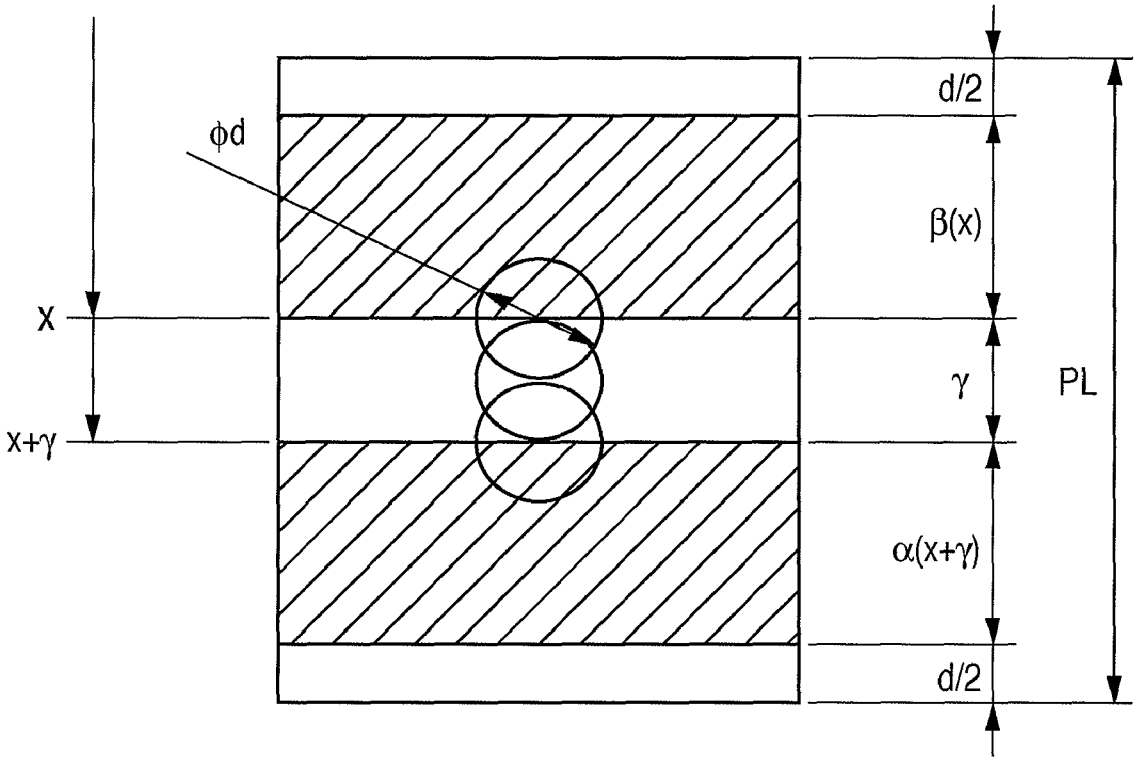
FIG. 7 is a view for explaining margins included in a patch.

Margins of a patch to cause the color sensor 90 to maintain the detection accuracy will be described below with reference to FIG. 7. FIG. 7 is a view for explaining margins included in a patch. The hatched region indicates the range where the image on the recording medium shifts from the ideal position, as in FIG. 6.

An example will be explained in which the color sensor detects a patch three times. Here, x is the distance from the leading edge of the recording medium, d is the detection spot diameter of the color sensor on the recording medium, and γ is the maximum distance of patch movement during patch detection. In this case, a conveyance-direction length PL of a patch is given by $$PL=\alpha(x+\gamma)+\beta(x)+\gamma+d$$

where α and β are the image expansion and contraction amounts. A margin for image expansion is set on the leading edge side of the patch. A margin for image contraction is set on the trailing edge side of the patch.

Figure 8:
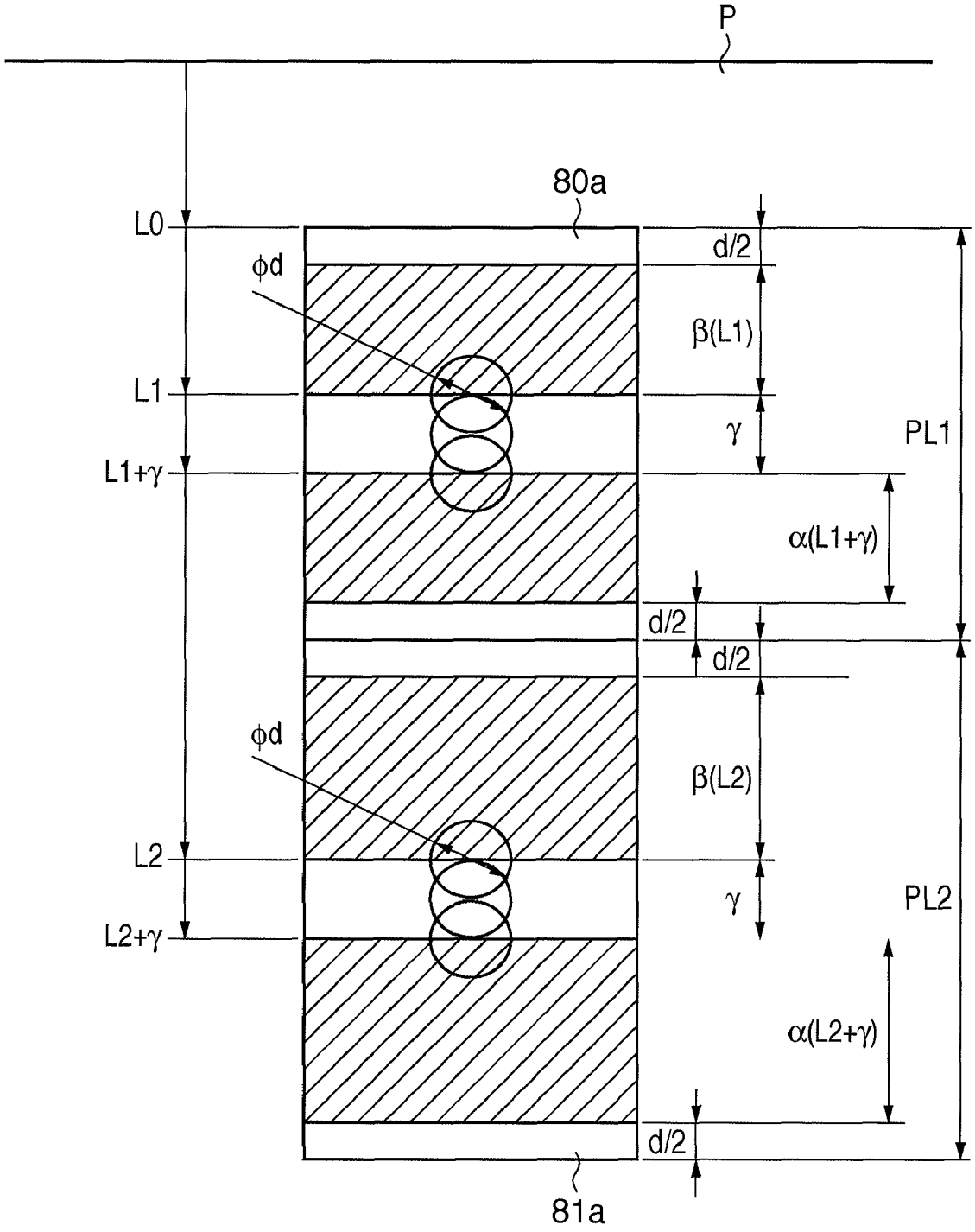
FIG. 8 is a view showing details of the conveyance-direction length of each patch according to the embodiment.

A method of determining the conveyance-direction length of the patch pattern 82 according to this embodiment will be described next with reference to FIG. 8. FIG. 8 is a view showing details of the conveyance-direction length of each patch according to this embodiment. The hatched region indicates the range where the image on the recording medium shifts from the ideal position, as in FIG. 6.

$L_0$ is the distance (mm) from the leading edge of the recording medium to the leading edge of the first patch. In this embodiment, $L_0$=5. L1 and L2 are the distances (mm) from the leading edge of the recording medium to the leading edges of the patch detection start positions of the first and second patches, respectively. $L_1+\gamma$ and $L_2+\gamma$ are the distances (mm) from the leading edge of the recording medium to the leading edges of the patch detection end positions of the first and second patches, respectively. The margins included in the respective patches are determined using the method described with reference to FIG. 7.

From FIG. 8, $$L_1=L_0+d/2+\beta(L_1)$$

Hence, $$L_1=(L_0+b+d/2)/(1-a)$$

Letting $L_n$ be the patch detection start position of the nth patch (n≧2), and $PL_n$ is the conveyance-direction length, $$L_n=L_{n-1}+\gamma+\alpha(L_{n-1}+\gamma)+d+\beta(L_n)$$

Hence, $$L_n=((1+a)(L_{n-1}+\gamma)+2b+d)/(1-a)$$

(n≧2)

$PL_n$ is given by $$PL_n=L_n+\gamma+\alpha(L_n+\gamma)+d/2$$

The arrangement of the patch pattern according to this embodiment is summarized in FIGS. 9 and 10 based on the above equations.

FIG. 9 is a view showing parameters associated with patch pattern formation and those of the related art. Item 1 represents an image expansion and contraction error on the recording medium at the patch detection position as the ratio (%) from the ideal value. Item 2 represents a position error caused by a speed variation at the patch detection position as the ratio (%) from the ideal value. Item 3 represents a maximum shift b (mm) between the leading edge of the recording medium and the leading edge of an image. This shift includes the detection error of the color sensor 90. Item 4 represents the conveyance-direction length (mm) of the recording medium to be used for patch pattern formation. In this example, assume that a recording medium having A3 size is used. Item 5 represents the margin $L_0$ (mm) at the leading edge of the recording medium. Item 6 represents the margin (mm) at the trailing edge of the recording medium. Item 7 represents the conveyance-direction length (mm) in an image formation enable region on the recording medium. Item 8 represents the leading edge-side margin α (mm) which must be included in one patch. Item 9 represents the trailing edge-side margin β (mm) which must be included in one patch. Item 10 represents the maximum value (mm/s) of the recording medium conveyance speed at the patch detection position. Item 11 represents a detection spot diameter ϕd (mm) of the color sensor 90. Item 12 represents the number k of times of detection (times) in one patch by the color sensor 90. Item 13 represents a time (s) necessary for detection of one cycle by the color sensor 90. Item 14 represents the maximum distance γ (mm) of movement of the recording medium during detection of one patch. Item 15 represents the conveyance-direction length (mm) of one patch. Item 16 represents the number of patches (pieces) formed on the recording medium. Item 17 represents the number n of tones (tones) of a patch. Item 18 represents a length (mm) necessary for forming all patches (patch pattern).

The sum of the errors of items 1 and 2 corresponds to the slope a (a=0.018) in FIG. 6. Item 3 corresponds to the intercept b (b=0.9) in FIG. 6.

In the related art, taking the image formation length of 410 mm on the recording medium into consideration, the margin to be included in all patches is set to α=β=ax+b=0.018×410 mm+0.9=8.28 mm. The maximum distance γ of movement of the recording medium during detection of one patch represented by item 14 is calculated based on items 10, 12, and 13. The conveyance-direction length of one patch is determined as 22.38 mm (=α+β+γ+d) Hence, in the related art, 18 patches can be formed on a paper sheet having A3 size. The sum of the conveyance-direction lengths of all patches (to be referred to as a total patch length hereinafter) is 407.8 mm.

On the other hand, in this embodiment, although γ does not change, α and β change depending on the patch formation position on the recording medium, as shown in FIG. 6. The parameters of each patch according to this embodiment will be described with reference to FIG. 10.

FIG. 10 is a view showing the parameters of the patch pattern according to this embodiment. FIG. 10 shows results obtained by calculating, using the above-described equations, the patch detection start position $L_n$ of the nth patch, the conveyance-direction length PLn of the patch, the margins α and β included in the patch, and the trailing edge position of the nth patch.

As shown in FIG. 10, when 18 patches are formed on the recording medium, like the related art, the total patch length is 202.5 mm. This is about ½ the conventional length of 407.8 mm. That is, the amount of toner necessary for patch formation can decrease to ½.

Conventionally, a recording medium having A3 size is necessary for controlling color balance correction. In this embodiment, however, a recording medium having A4 size suffices. For example, when the user is going to output an image using a recording medium having A4 size, the related art requires using two or more printing media having A4 size or set a recording medium having A3 size purposely. In this embodiment, however, it is possible to execute color balance correction using only one recording medium having A4 size which is already set in the apparatus main body 2 for image formation. This means that this embodiment decreases the toner consumption and also shortens the correction control time, as compared to the related art.

In the related art, only 18 patches can be formed on a paper sheet having A3 size. In this embodiment, however, 28 patches can be formed on a paper sheet having A3 size (image formation length=410 mm), as is apparent from FIG. 10. That is, the number of patches can be increased without increasing the toner consumption, as compared to the related art. It is therefore possible to improve the color balance correction accuracy.

Figure 11:
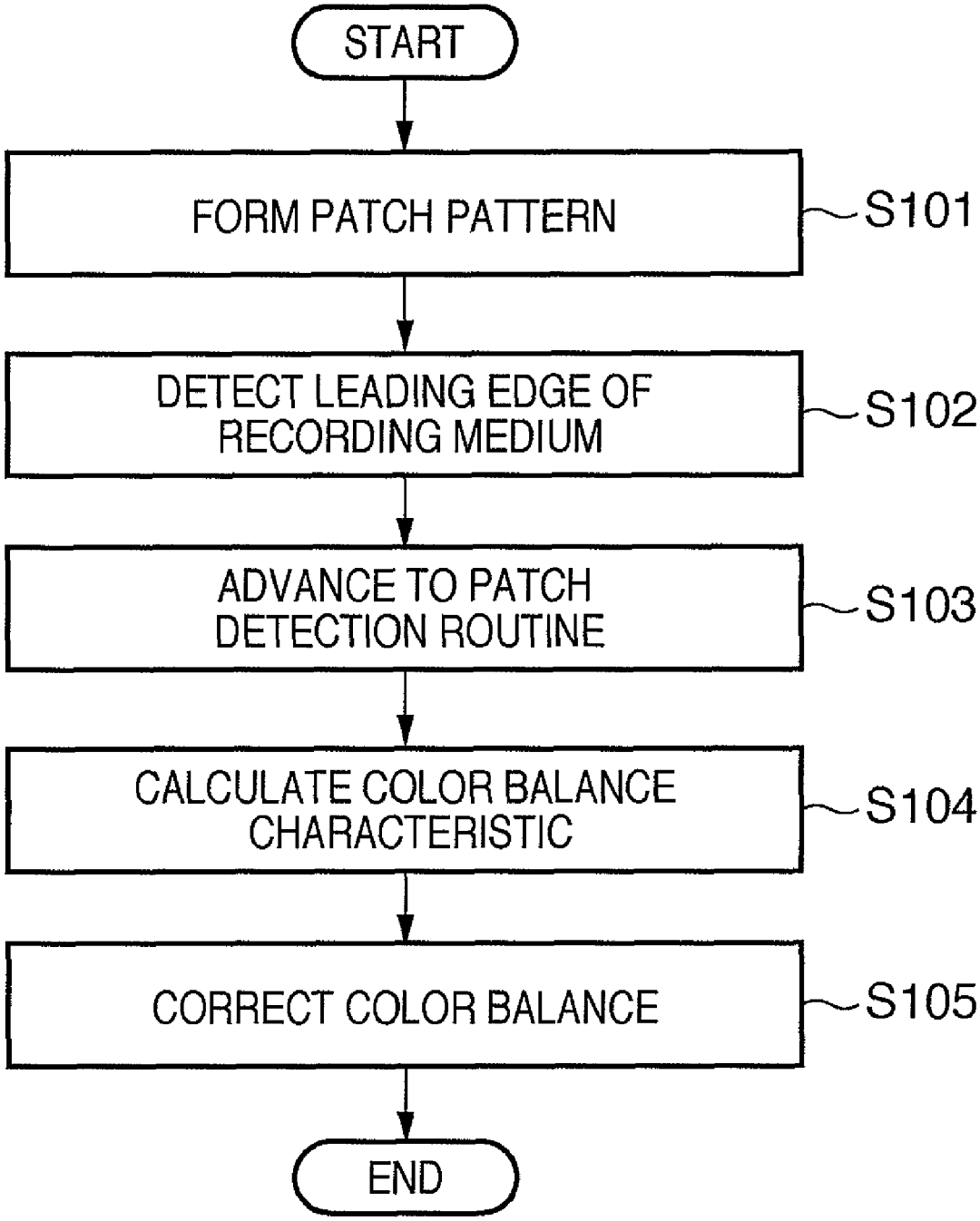
FIG. 11 is a flowchart illustrating the control procedure of color balance correction control in the printer 1 according to the embodiment.

FIG. 11 is a flowchart illustrating the control procedure of color balance correction control in the printer 1 according to this embodiment. A program for executing color balance correction control is stored in the ROM 122 shown in FIG. 2 and executed under the control of the CPU 121.

In step S101, the CPU 121 forms the patch pattern 82 on the recording medium P. The patch pattern is formed wholly on one recording medium P or divisionally on a plurality of printing media P depending on the conveyance-direction length of the recording medium P to be used. The CPU 121 may acquire the conveyance-direction length of the recording medium P from information from the above-described size detection unit 14 provided in the cassette 20. The CPU 121 may acquire the conveyance-direction length from information input by the user via the external host device 10 in association with the recording medium P set by the user on the manual feed unit of the apparatus main body 2.

In step S102, the CPU 121 detects an output V0 of the color sensor without the recording medium P to be used to determine that the leading edge-side margin of the recording medium has reached the detection range of the color sensor 90. In this case, the output from the color sensor 90 upon detecting a black counter plate (not shown) provided on the opposite side of the color sensor 90 is defined as V0. After that, when then color sensor 90 continues detection, and the output from it exceeds a threshold value for determining the arrival of the recording medium, the CPU 121 resets a time counter tc. The time counter tc is used to count a predetermined time from the timing when the leading edge of the recording medium has arrived at the detection range of the color sensor 90 to determine the execution timing of patch detection. The detection range of the color sensor 90 corresponds to the spot diameter of the color sensor 90.

In step S103, when the time counter tc has counted the predetermined time, the CPU 121 starts patch pattern detection and calculates the densities or chromaticities of all patches. The patch detection processing in step S103 will be described later with reference to the flowchart in FIG. 12.

In step S104, the CPU 121 calculates a color balance characteristic to correct image formation conditions using the detected density or chromaticity of each patch. In step S105, the CPU 121 calculates a correction conversion table for color balance correction. The correction conversion table is used to correct image formation conditions by feedback to process conditions such as a laser beam exposure amount and a development bias.

Figure 12:
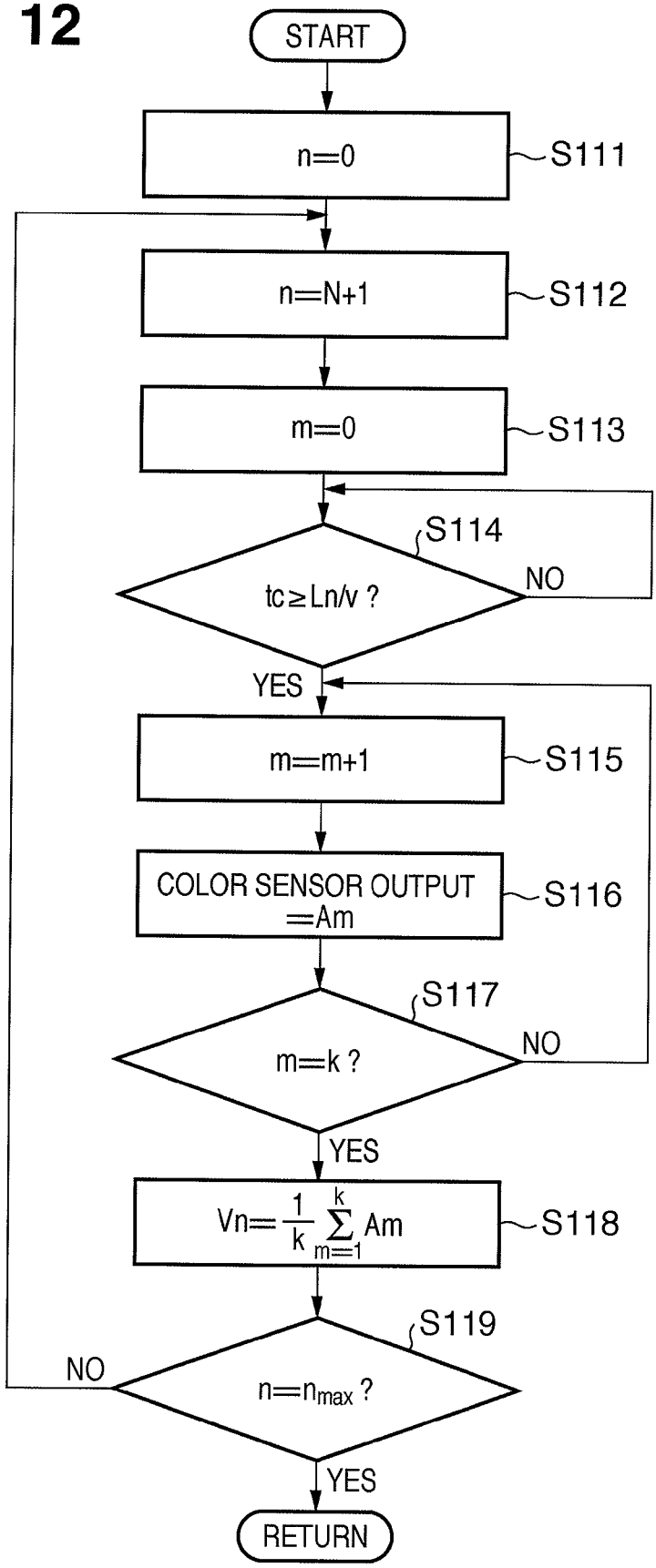
FIG. 12 is a flowchart illustrating the process procedure of patch detection processing according to the embodiment.

The patch detection processing will be described next with reference to FIG. 12. FIG. 12 is a flowchart illustrating the process procedure of patch detection processing according to this embodiment. The processing to be described below indicates details of the processing in step S103 of FIG. 11. This processing starts after the recording medium P having a patch pattern has reached the color sensor 90 to detect the densities or all patches included in the patch pattern. A program for executing the patch detection processing is stored in the ROM 122 shown in FIG. 2 and executed under the control of the CPU 121, like the processing shown in FIG. 11.

In step S111, the CPU 121 resets a patch counter n representing a patch number to "0". The patch counter n takes values from "0" to $n^{max}$ (the number of tones of a patch) so that n=1 represents the first patch, and n=2 represents the second patch. In step S111, the CPU 121 also clears V1 to Vn which store the density detection values of the patches to "0".

In step S112, the CPU 121 increments the patch counter n (+1). In step S113, the CPU 121 resets an output holding counter m representing the number of times of holding the output from the color sensor 90 to "0". The output holding counter m takes values from "0" to k (the number k of times of detection in one patch). In this embodiment, k=3.

In step S114, the CPU 121 determines whether it is time to start detection of the nth patch. Whether it is the detection start timing is determined depending on whether the time counter tc has exceeded the threshold value $L_n/v$, where v is the design value of the recording medium conveyance speed at the patch detection position, and v=200 mm/s. If it is determined that it is time to start detection, the CPU 121 advances the process to step S115. If it is determined that it is not time to start detection, the CPU 121 periodically repeats the determination in step S114 until the detection start timing.

In step S115, the CPU 121 increments the value of the output holding counter m (+1). In step S116, the CPU 121 sets the detection value (output value) of the color sensor 90 in a variable Am. The variable Am is allocated in the RAM 123 as a work area.

In step S117, the CPU 121 determines whether detection of k times necessary for calculating the density of one patch is ended. If detection of k times in one patch is not ended yet, the CPU 121 returns the process to step S115 to increment the value of the output holding counter m (+1) and set the next detection result in the variable Am. In this way, patch density detection by the color sensor 90 is performed k times at a predetermined sampling cycle, and the detection values are stored in A1 to Ak.

In step S118, the CPU 121 obtains the arithmetic mean of the k detection values detected by the color sensor 90, thereby calculating the density Vn of the patch. In this embodiment, the simple arithmetic mean of three data is obtained as a patch density in step S118. Alternatively, the number of times of detection may be increased so that the mean of detection values except the maximum and minimum values may be obtained as a patch density.

Finally, in step S119, the CPU 121 determines whether detection of the densities of all patches is ended. If the detection is not ended, the CPU 121 returns the process to step S112 to start detecting the next patch. When the densities of all patches are detected, this processing is ended. Then, the processing in step S104 of FIG. 11 is executed.

As described above, the image forming apparatus according to this embodiment optimizes the area and position of each patch included in the patch pattern in accordance with the image printing accuracy (the expansion and contraction characteristic and the shift of the print start position) at the patch detection position or the characteristic of the patch moving speed at the patch detection position. More specifically, the image forming apparatus determines the conveyance-direction length of each patch, which is necessary for solving expansion and contraction of a toner image at the patch detection position or a variation in the moving speed of the recording medium at the patch detection position, in accordance with the formation position of each patch on the recording medium. This allows forming each patch for color balance correction in a minimum conveyance-direction length. This makes it possible to reduce the consumption of printing media and toners to be used in color balance correction and efficiently perform color balance correction. Since the patch area on the recording medium can be reduced, the number of patches can be increased. In this case, it is possible to increase the color balance correction accuracy without increasing the toner consumption.

The present invention is not limited to the above-described embodiment, and various changes and modifications can be made. For example, the conveyance-direction length of each patch may be set to gradually increase in the order of detection. This enables to solve the characteristic that the expansion and contraction amount of the toner image formed at the end in the conveyance direction of the recording medium is larger than that of the toner image formed at the top and achieve the optimum patch size at the formation position of each patch. It is therefore possible to further decrease the toner consumption and efficiently execute color balance control.

The conveyance-direction length of each patch according to this embodiment may include the spot diameter of the color sensor 90, the maximum distance of patch movement during detection processing, and the maximum expansion and contraction amount of a toner image corresponding to the formation position of each patch on the recording medium. This makes it possible to more accurately detect each patch and reduce toner consumption without degrading the image quality of the image forming apparatus.

The image forming apparatus according to this embodiment may count the number of times of image forming operations and change the conveyance-direction length of each patch when the number of times has reached a predetermined number of times. That is, when the number of times of image forming operation exceeds a predetermined threshold value, the values "a" and "b" in $\alpha(x)$ and $\beta(x)$ described above are changed. As the values obtained by the change, appropriate values are calculated in advance in the design stage of the image forming apparatus. In this case, the CPU 121 of the image forming apparatus functions as a change unit for changing the conveyance-direction length of each patch in accordance with the number of times image forming operation. This eliminates the influence of variations in images caused by changes over time of each engine depending on the number of times of image forming operations.

The image forming apparatus according to this embodiment may determine the type of a recording medium and change the conveyance-direction length of each patch in accordance with the determined type of the recording medium. That is, the values "a" and "b" in $\alpha(x)$ and $\beta(x)$ described above are changed depending on the type of a recording medium (e.g., plain paper or glossy paper). As the values obtained by the change, appropriate values are calculated in advance in the design stage of the image forming apparatus. In this case, the CPU 121 of the image forming apparatus functions as a change unit for changing the conveyance-direction length of each patch in accordance with the type of a recording medium. This enables to execute accurate patch detection processing without any influence of the image formation characteristic that changes depending on the type of a recording medium. To determine the type of a recording medium, the image forming apparatus may include an optical sensor to determine the type of a recording medium on the recording medium conveyance path. Alternatively, the image forming apparatus may acquire the type of a recording medium by user input.

The tone-density characteristic control patch pattern formed and fixed on a recording medium is not limited to a gray patch pattern. Even when tone patch patterns of single colors of C, M, Y, and Bk are used, the effect of the present invention can be obtained.

The effect of the present invention can be obtained not only in detecting patches on a recording medium using a color sensor but also in detecting a tone-density control patch on the intermediate transfer member.

In this embodiment, a color image forming apparatus using an electrophotographic method has been described as an example of the image forming apparatus. The embodiment is also applicable to various image forming apparatuses to do, for example, density control of a monochrome image forming apparatus or density/chromaticity control of an inkjet image forming apparatus.

Other Embodiments

Modifications of the above-described embodiment will be described below.

In the above-described embodiment, the image expansion and contraction characteristic on a recording medium is set as shown in FIG. 6. The margins $\alpha(x)$ and $\beta(x)$ included in the patch in FIG. 6 can be either nonlinear or a higher-order function if they conform to the actual image expansion and contraction characteristic.

It is known regarding the printer 1 shown in FIG. 1 that the printing accuracy (the shift of the print start position or the degree of image expansion and contraction) on the recording medium changes depending on the temperature and/or humidity of the environment where the apparatus main body 2 is installed or an increase in the temperature and/or humidity in the apparatus main body 2. When the margins shown in FIG. 6 are changed using an environment sensor for detecting the temperature and humidity of the environment where the apparatus main body 2 is installed or the temperature and humidity in the apparatus main body 2, the patch pattern area can be made smaller. Note that the environment information is not limited to the temperature or humidity. For example, a combined value of temperature and humidity may be employed. At this time, the CPU 121 functions as a change unit for changing the conveyance-direction length of each patch in accordance with detected environment information or changing the conveyance-direction length of each patch in accordance with detected environment in the apparatus.

For example, under a specific environment, $\alpha(x)=b$, and $\beta(x)=ax+b$ are set. Under another environment, $\alpha(x)=ax+b$, and $\beta(x)=b$ are set. This allows further optimizing the patch pattern. The values "a" and "b" may appropriately be changed in accordance with the environment (temperature and/or humidity). The effect of the present invention can also be enhanced by changing the margins included in a patch in accordance with a change in the printing accuracy on the recording medium caused by the endurance deterioration of the printer 1 or a change in the printing accuracy caused by the type of the recording medium itself.

If the printer 1 supports double-sided printing, the color balance correction described in the present invention may be done for the image on the second surface. In this case, the shrinkage amount of the recording medium after fixing on the first surface is different from that on the second surface. For this reason, the patch pattern for the first surface and that for the second surface can be optimized separately. More specifically, the values "a" and "b" in $\alpha(x)$ and $\beta(x)$ described above are changed between the first surface and the second surface in double-sided printing. As the values obtained by the change, appropriate values are calculated in advance in the design stage of the image forming apparatus.

If the image on the recording medium tends to shift in the width direction as it advances in the conveyance direction, the patches are preferably formed to solve the shifts. For example, if the recording medium is skewed at a patch detection position, each patch included in the patch pattern is gradually made wider in the conveyance direction. This allows optimizing the patch pattern.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-324009 filed on Dec. 14, 2007 and 2008-297099 filed on Nov. 20, 2008, which are hereby incorporated by reference herein in their entirety.

What is claimed is:

1. An image forming apparatus comprising:

patch formation unit configured to form, on a recording medium, a patch array including a plurality of patches formed by toner images;

fixing unit configured to fix, to the recording medium, the patch array formed on the recording medium;

patch detection unit configured to detect a density or color of each patch of the patch array fixed on the recording medium that is conveyed; and correction unit configured to correct an image formation condition based on the detected density or color of the each patch, wherein said patch formation unit forms the patches as the patch array so that the conveyance-direction length of each patch gradually increases in an order of detection by said patch detection unit, and wherein the conveyance-direction length of each patch gradually increases according to increasing, from an ideal position, of a detection position variation amount of a patch in the order of detection by said patch detection unit.

2. The apparatus according to claim 1, wherein the conveyance-direction length of each patch includes a spot diameter of a photosensor to be used by said patch detection unit to detect the density or color of each patch, a distance of patch movement during detection of the density or color by said patch detection unit, and a shift of a toner image corresponding to a formation position of each patch on the recording medium.

3. The apparatus according to claim 1, further comprising environment detection unit configured to detect an environment information of environment where the image forming apparatus is installed or environment information in the image forming apparatus, wherein said patch formation unit comprises change unit configured to change the conveyance-direction length of each patch in accordance with the detected environment information.

4. The apparatus according to claim 1, further comprising count unit configured to count the number of times of image forming operations of the image forming apparatus, wherein said patch formation unit further comprises change unit configured to change the conveyance-direction length of each patch when the number of times has reached a predetermined number of times.

5. The apparatus according to claim 1, further comprising determination unit configured to determine a type of a recording medium, wherein said patch formation unit comprises change unit configured to change the conveyance-direction length of each patch in accordance with the determined type of the recording medium.

6. The apparatus according to claim 1, wherein said patch formation unit comprises change unit configured to, when patches are formed on both surfaces of a recording medium, change the conveyance-direction length of each patch between a first surface and a second surface of the recording medium.

7. The apparatus according to claim 1, wherein the detection position variation amount includes one of a variation in a conveyance speed of the recording medium, shrinkage of the recording medium that has passed through a fixing device, and expansion and contraction of an image until image formation on the recording medium.

8. A method of controlling an image forming apparatus, comprising the steps of:

forming, on a recording medium, a patch array including a plurality of patches by toner images;

fixing, to the recording medium, the patch array formed on the recording medium;

causing patch detection unit to detect a density or color of each patch of the patch array fixed on the recording medium that is conveyed; and correcting an image formation condition based on the detected density or color of the each patch, wherein in the patch forming step, the patches are formed as the patch array so that the conveyance-direction length of each patch gradually increases in an order of detection by said patch detection unit, and wherein the conveyance-direction length of each patch gradually increases according to increasing of a detection position variation amount of a patch in the order of detection by the patch detection unit.

* * * * *